US007086207B2

(12) United States Patent
Piburn et al.

(10) Patent No.: US 7,086,207 B2
(45) Date of Patent: Aug. 8, 2006

(54) ANTENNA SECTOR FRAME

(75) Inventors: Darin Piburn, Keller, TX (US); Dale Heath, Stillwater, OK (US); Kevin Paswalk, Watauga, TX (US); Kevin Rovell, Forth Worth, TX (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 11/148,898

(22) Filed: Jun. 9, 2005

(65) Prior Publication Data

US 2006/0087476 A1 Apr. 27, 2006

(51) Int. Cl.
*E04H 12/18* (2006.01)

(52) U.S. Cl. ..... 52/645; 52/736.2; 248/512; 248/514; 248/539; 248/540; 248/678; 248/679; 343/892; 343/890; 343/879; 343/891; 343/874; 343/875

(58) Field of Classification Search ..... 52/651.01, 52/736.2, 645; 248/512, 514, 539, 540, 678, 248/679; 343/892, 890, 879, 891, 874, 875
See application file for complete search history.

(56) References Cited

U.S. PATENT DOCUMENTS 3,247,516 A * 4/1966 Rohn et al. ..... 343/890
4,231,200 A 11/1980 Henderson
4,420,917 A 12/1983 Parlanti
4,442,919 A 4/1984 Fulcher
4,450,450 A 5/1984 Ellingson
4,468,671 A * 8/1984 Ellingson et al. ..... 343/766
4,614,502 A 9/1986 Nelson
4,745,412 A * 5/1988 Creaser, Jr. ..... 343/890
4,755,830 A * 7/1988 Plunk ..... 343/890
4,942,537 A 7/1990 Verry
5,216,867 A 6/1993 Wasterval
5,490,364 A 2/1996 Desai
5,524,398 A 6/1996 Miller
5,533,304 A * 7/1996 Noble ..... 52/40
D399,595 S 10/1998 Miller et al.
5,920,291 A * 7/1999 Bosley ..... 343/892
5,926,151 A 7/1999 Hagiwara
5,971,345 A * 10/1999 Khalaf ..... 248/512
6,145,269 A 11/2000 Fisher
6,222,503 B1 4/2001 Gietema
6,222,504 B1 4/2001 Oby
6,262,691 B1 7/2001 Austin
6,283,425 B1 9/2001 Liljevik
6,321,501 B1 11/2001 Ignash
6,321,503 B1 11/2001 Warren
6,345,482 B1 2/2002 Warren (Continued)

OTHER PUBLICATIONS http://www.andrew.com/products/steel/ (May 12, 2005).

(Continued)

*Primary Examiner*—Carl D. Friedman
*Assistant Examiner*—Tiara Robertson
(74) *Attorney, Agent, or Firm*—Muskin & Cusick LLC

(57) ABSTRACT

An antenna sector frame that can collapse for easy transport and storage. The antenna frame can be packaged with all of its loose parts in a single container on a relatively flat single skid capable of being stacked in storage. The antenna frame can include a pair of face frames configured to support one or more antennas, the face frames being joined to articulate on a face frame pivot axis such that the face frames can be folded together for compact shipment and storage and opened for use.

2 Claims, 17 Drawing Sheets

U.S. PATENT DOCUMENTS

| | | | | |
|---|---|---|---|---|
| 6,374,565 | B1 | 4/2002 | Warren | |
| 6,407,711 | B1 | 6/2002 | Bonebright | |
| 6,452,567 | B1 | 9/2002 | Overton | |
| 6,456,258 | B1 * | 9/2002 | Bragg et al. | 343/892 |
| 6,469,679 | B1 | 10/2002 | Yoshida | |
| 6,512,492 | B1 * | 1/2003 | Overton | 343/891 |
| 6,560,942 | B1 | 5/2003 | Warren | |
| 6,578,339 | B1 | 6/2003 | McGinnis | |
| 6,708,455 | B1 | 3/2004 | Niiduma | |
| 6,710,751 | B1 * | 3/2004 | Ianello et al. | 343/890 |
| 6,739,561 | B1 | 5/2004 | Herzog | |
| 6,768,474 | B1 * | 7/2004 | Hunt | 343/892 |
| 6,782,667 | B1 | 8/2004 | Henderson | |
| 6,786,302 | B1 | 9/2004 | Liew | |
| 6,871,469 | B1 | 3/2005 | Lissandre | |
| 6,879,055 | B1 | 4/2005 | Becker | |
| 2001/0036843 | A1 | 11/2001 | Thompson | |
| 2002/0089466 | A1 | 7/2002 | Magee | |
| 2002/0105476 | A1 | 8/2002 | Overton | |
| 2003/0122728 | A1 | 7/2003 | Antoine | |
| 2003/0213647 | A1 | 11/2003 | St. Germain | |
| 2004/0098941 | A1 | 5/2004 | Cornell | |
| 2004/0119655 | A1 | 6/2004 | Hunt | |
| 2004/0169114 | A1 | 9/2004 | Dierkes | |
| 2005/0001131 | A1 | 1/2005 | Stevens | |
| 2005/0001781 | A1 | 1/2005 | Antoine | |

OTHER PUBLICATIONS http://scframing.com/ (Jun. 9, 2005) (Appeared prior to this date).

http://www.internationaltowersupply.com/index.htm (Jun. 9, 2005) (Appeared prior to this date).

http://www.hometech.com/video/antmount.html (May 12, 2005).

http://www.teeveesupply.com/product_pages/antennas/antenna_mounting_hardware.htm (May 12, 2005).

http://www.amdpaolini.com/ecomepa.htm (May 12, 2005).

http://www.antenna.it/antennas1.htm (May 12, 2005).

http://www.td.dgs.ca.gov/Services/OPSRS/default.htm (May 12, 2005).

http://www.agp-manila.com/page3.html (May 12, 2005).

http://www.intelcotowers.com/ (Jun. 9, 2005) (Appeared prior to this date).

* cited by examiner

Prior Art

ANTENNA SECTOR FRAME

FIELD OF THE INVENTION

The present inventive concept relates to antenna frames, and in particular to an antenna sector frame.

BACKGROUND OF THE INVENTION

Tower sector frames are widely used in the telecommunications industry to mount antennas for communications reception. Tower sector frames have to be assembled at the point of installation before they are mounted onto the tower itself. This assembly is costly and time consuming as it requires mounting various portions of the frame to one another and bolting them together. There are a variety of antenna frames in the industry. There are many deficiencies in the prior art tower sector frames.

When a sector frame (or "sector frame mount") is assembled, it is typically hoisted up on the tower with a rope or a cable. The sector mount is then attached to one of the three legs of the tower. Because the tower legs are at an angle to the vertical (typically about 4 degrees), a problem can be envisioned if the frames are rotated to change the azimuth point of the beam. So the first task is to get the face frames vertical despite the angle of the tower leg upon which the frames are mounted.

To address this problem, prior art devices use a set of bolt holes progressively farther from the tower to compensate for tilt. If there doesn't happen to be a bolt hole in just the right spot, a hole must be drilled. This can be difficult to do once up on the tower.

A further deficiency of the prior art is that prior art sector frame mounts are difficult to transport as they typically come in two skids on a flatbed truck. Further, prior art sector frame mounts are difficult to assemble as they can use 96 nuts just to assemble a front gate portion. A prior art sector mount can also take from one to four hours of assembly time.

Yet a further deficiency of the prior art is an inability for a prior art sector frame to adjust its pointing direction when installed.

It would thus be beneficial if an antenna frame existed that could be rapidly assembled so as to limit the amount of cost expended on an installer having to assemble the antenna frame prior to installation, as well as overcoming the other deficiencies in the prior art.

BRIEF DESCRIPTION OF THE DRAWINGS

The foregoing summary, as well as the following detailed description of a preferred embodiment of the present inventive concept will be better understood when read with reference to the appended drawings, wherein.

DETAILED DESCRIPTION OF THE PREFERED EMBODIMENTS

Figure 1:
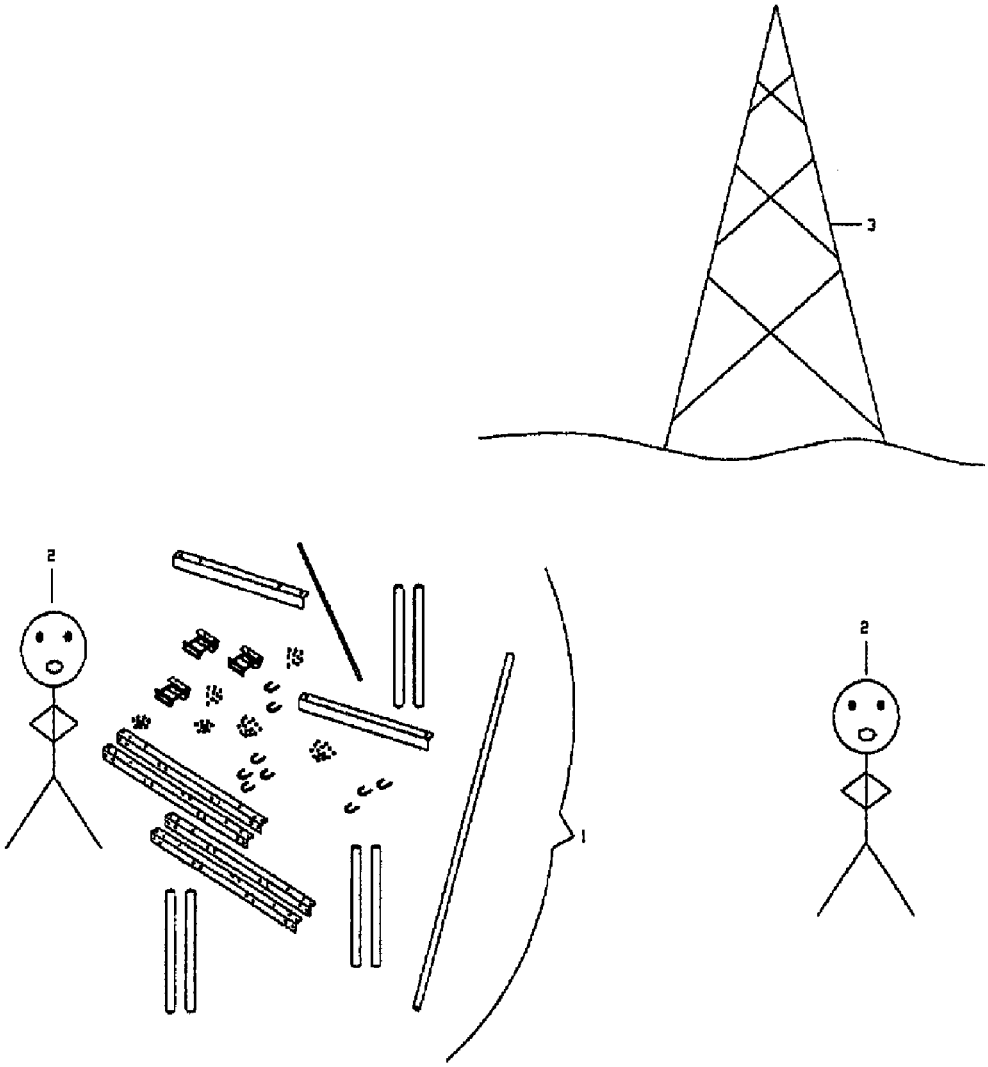
FIG. 1 is a block diagram illustrating the prior art.

Reference will now be made in detail to the presently preferred embodiments of the inventive concept, examples of which are illustrated in the accompanying drawings, wherein like reference numerals refer to like elements throughout.

It is an aspect of the present inventive concept to provide an antenna sector frame that has improved capabilities and characteristics over the prior art.

The above aspects can be obtained by an antenna sector frame that includes (a) a pair of face frames configured to support one or more antennas, the face frames being joined to articulate on a face frame pivot axis such that the face frames can be folded together for compact shipment and storage and opened for use; and (b) a standoff adapted to be coupled to the pivotally joined pair of face frames and configured to support the face frames at a distance from a tower or other support structure.

The above aspects can also be obtained by an antenna sector frame that includes (a) a face frame structure configured to support one or more antennas; (b) a standoff adapted to be pivotally coupled to the face frame structure on a face pivot axis and configured to support the face frame structure at a distance from a tower or other support structure; and (c) a mounting arrangement configured to mount the standoff on the support structure, such that the standoff pivots with respect to the support structure on a support pivot axis substantially parallel to said face pivot axis.

The above aspects can also be obtained by an antenna sector frame that includes (a) a face frame structure configured to support one or more antennas; (b) a standoff adapted to be coupled to the face frame structure on a face pivot axis and configured to support the face frame structure at a distance from a tower or other support structure; and (c) a mounting arrangement configured to mount the standoff on the support structure, the mounting structure being configured to permit the sector frame mount to be tilted through a continuous, non-discrete range of tilt settings with respect to the support structure to compensate for tilt in the support structure.

The above aspects can also be obtained by an antenna sector frame that includes (a) a standoff frame having a first end and a second end, wherein the first end of the standoff frame is adapted for mounting to a structure; (b) at least one pivot plate mounted at the second end of the standoff frame; (c) a first face frame, pivotally mounted to the pivot plate; and (d) a second face frame, pivotally mounted to the pivot plate.

The above aspects can also be obtained by a method that includes (a) providing in substantially preassembled form a sector frame mount comprising: (b) a pair of face frames configured to support one or more antennas, the face frames being joined to articulate on a face frame pivot axis such that the face frames can be folded together for compact shipment and storage and opened for use; and (c) a standoff adapted to be coupled to the pivotally joined pair of face frames and configured to support the face frames at a distance from a tower or other support structure, the standoff being pivotally joined to the pair of face frames in the region of said face pivot axis and adapted to fold together with the pair of face frames for compact shipping and storage; (d) shipping the substantially preassembled sector frame mount to the erection site; (e) pivotally opening the sector frame mount and locking the face frames in a substantially planar geometry; and (f) completing the final assembly of the sector frame mount.

These together with other aspects and advantages which will be subsequently apparent, reside in the details of construction and operation as more fully hereinafter described and claimed, reference being had to the accompanying drawings forming a part hereof, wherein like numerals refer to like parts throughout.

The present general inventive concept relates to an antenna sector frame which can be folded for easy storage, transport, and assembly. The antenna frame requires small storage space compared to the prior art. The antenna frame is also relative quick and easy to assemble, relative to the prior art. The antenna frame can also be easily pivoted on dual axis.

FIG. 1 is a block diagram illustrating the prior art. Antenna frame pieces 1 need to be assembled by operators 2 and attached on an antenna tower 3. This can be difficult as some of the assembly needs to be performed up on the tower itself.

Figure 2A:
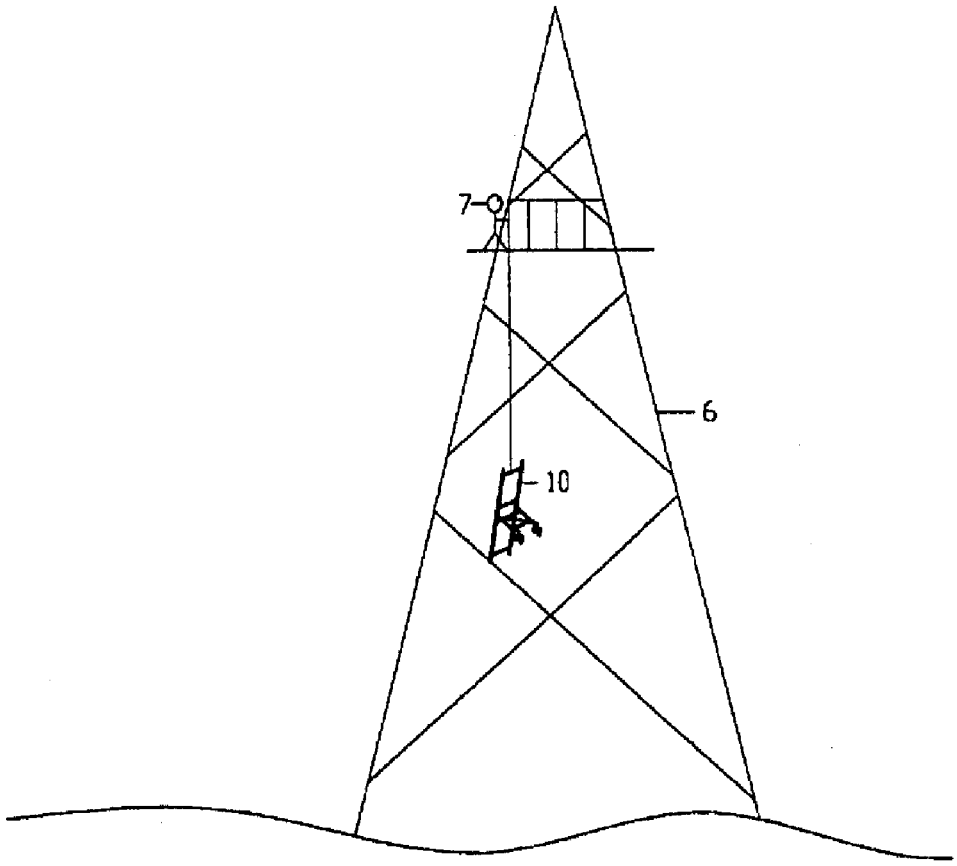
FIG. 2A is a block diagram illustrating hoisting of an antenna frame, according to an embodiment.

FIG. 2A is a block diagram illustrating hoisting of an antenna frame, according to an embodiment. An antenna tower 6 has an operator 7 which hoists an antenna frame 10 up onto the tower for installation. The antenna frame 10 can be hoisted already assembled which will require minimal assembly up on the antenna tower 6, as compared to the prior art which can require substantial assembly both on the ground and up on the tower.

Figure 2B:
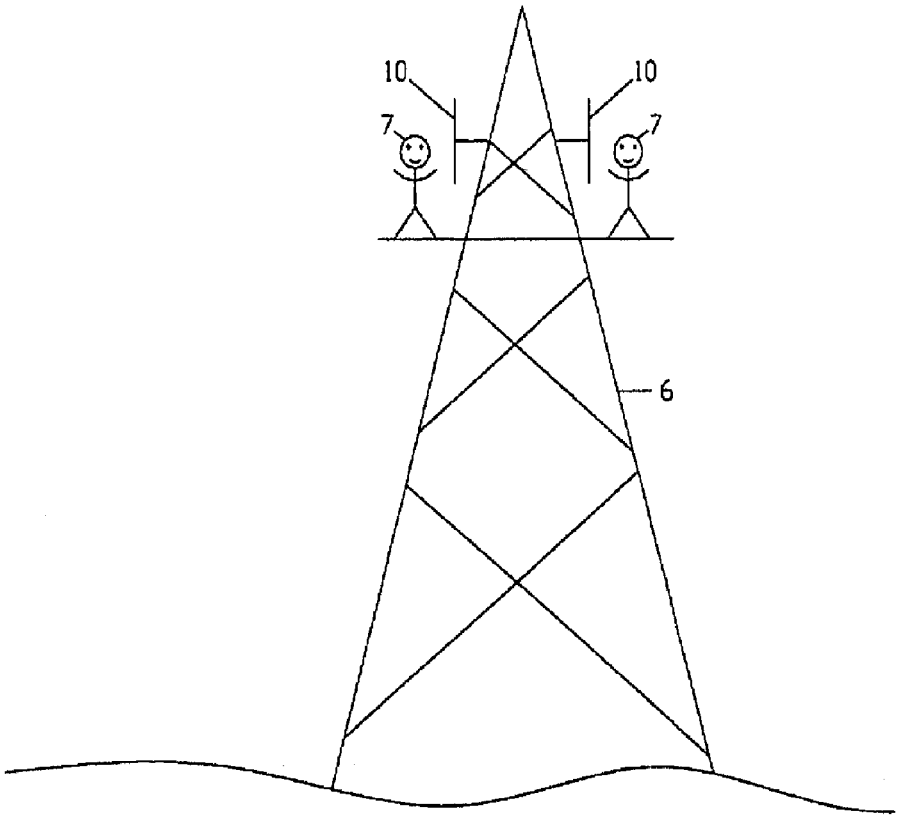
FIG. 2B is a block diagram illustrating installed antenna frames, according to an embodiment.

FIG. 2B is a block diagram illustrating installed antenna frames, according to an embodiment. The operators 7 have easily installed the antenna frames 10 up the antenna tower 6.

Figure 3:
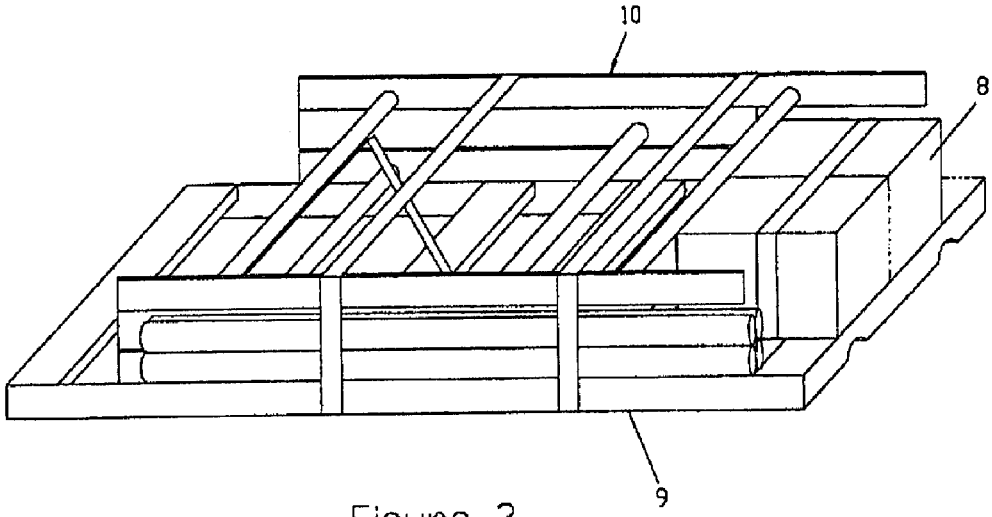
FIG. 3 is an isometric view of a collapsed antenna frame on a skid, according to an embodiment.

FIG. 3 is an isometric view of a collapsed antenna frame on a skid, according to an embodiment.

An antenna sector frame 10 is in a collapsed (or retracted) position and is positioned on a single skid 9 and can fit on a box truck. This in contrast to the prior art which can require two skids transported on a flat bed. Skids can also be stacked which can result in reduced storage costs. In addition, the antenna frame 10 contains fewer loose parts as opposed to prior art devices.

A skid 9 can hold components such as the folded frame assembly, a box 8 containing the loose parts (e.g. U-bolts, nuts, saddle mounts, etc.) and knocked-down pipes. Pipes can be knocked-down (e.g. disassembled into smaller pieces) and can be joined upon installation.

An antenna frame as described herein can be easily stored while also easily assembled for installation. FIGS. 4–8 illustrate a sequence of transforming an antenna frame from a collapsed position, to a partially opened position, to a fully opened position, to a fully opened position with mounting members attached, to a fully opened position with mounting members and a tie back bar attached.

Figure 4:
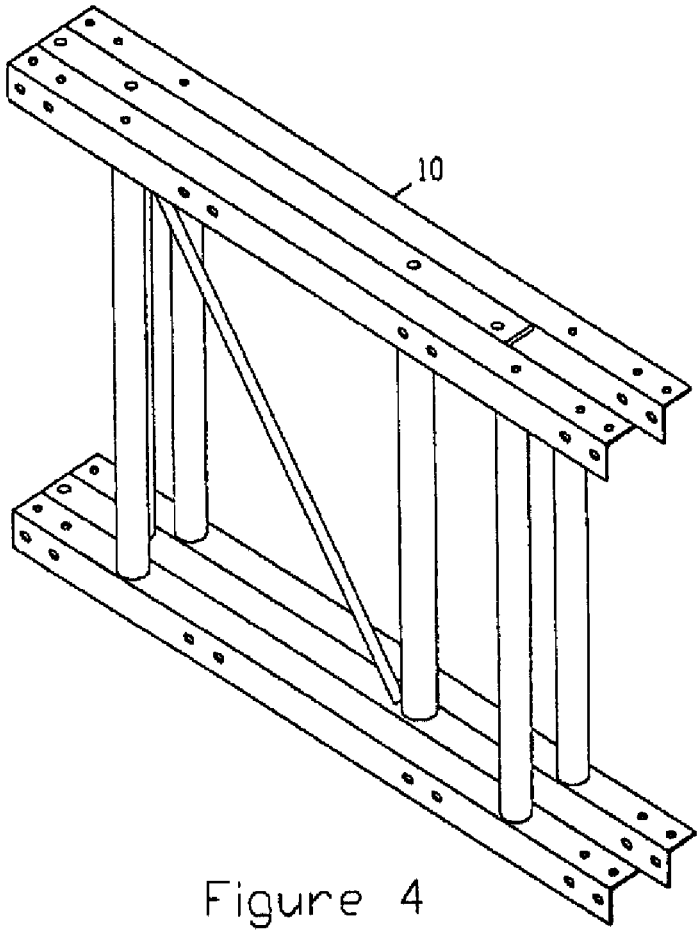
FIG. 4 is an isometric view of a collapsed antenna frame, according to an embodiment.

FIG. 4 is an isometric view of a collapsed antenna frame, according to an embodiment. The antenna frame 10 is collapsed which takes up a relatively small amount of space.

Figure 5:
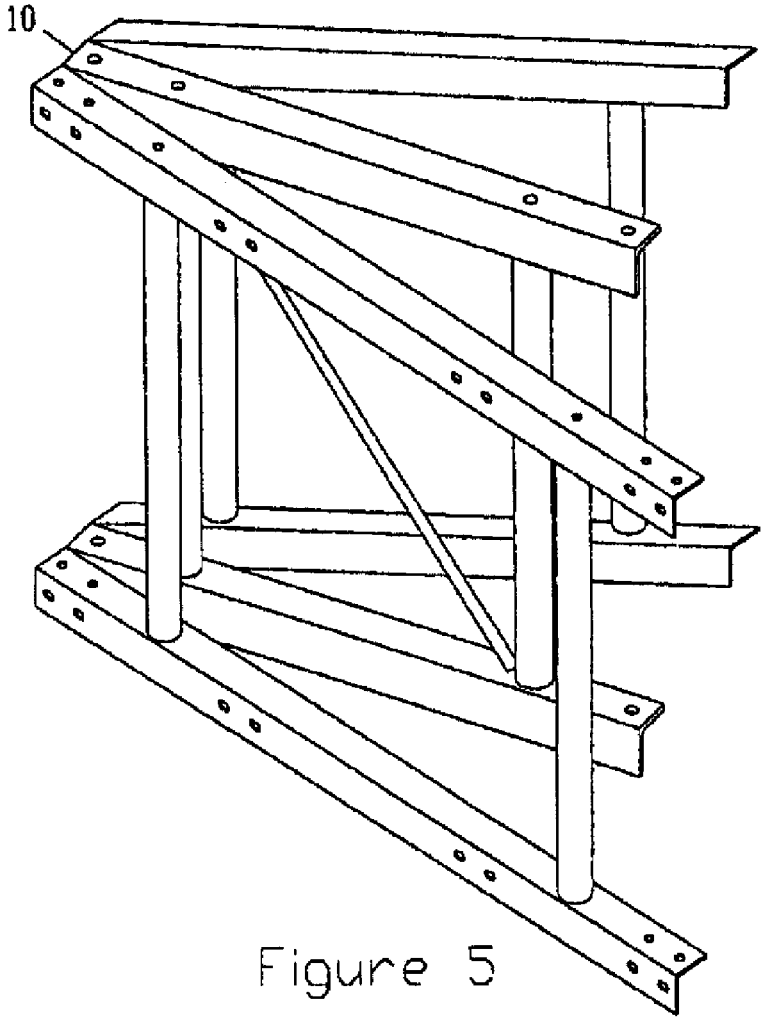
FIG. 5 is an isometric view of a partially opened antenna frame, according to an embodiment.

FIG. 5 is an isometric view of a partially opened antenna frame, according to an embodiment. While being opened, the antenna frame 10 transforms from a collapsed state into an expanded state.

Figure 6:
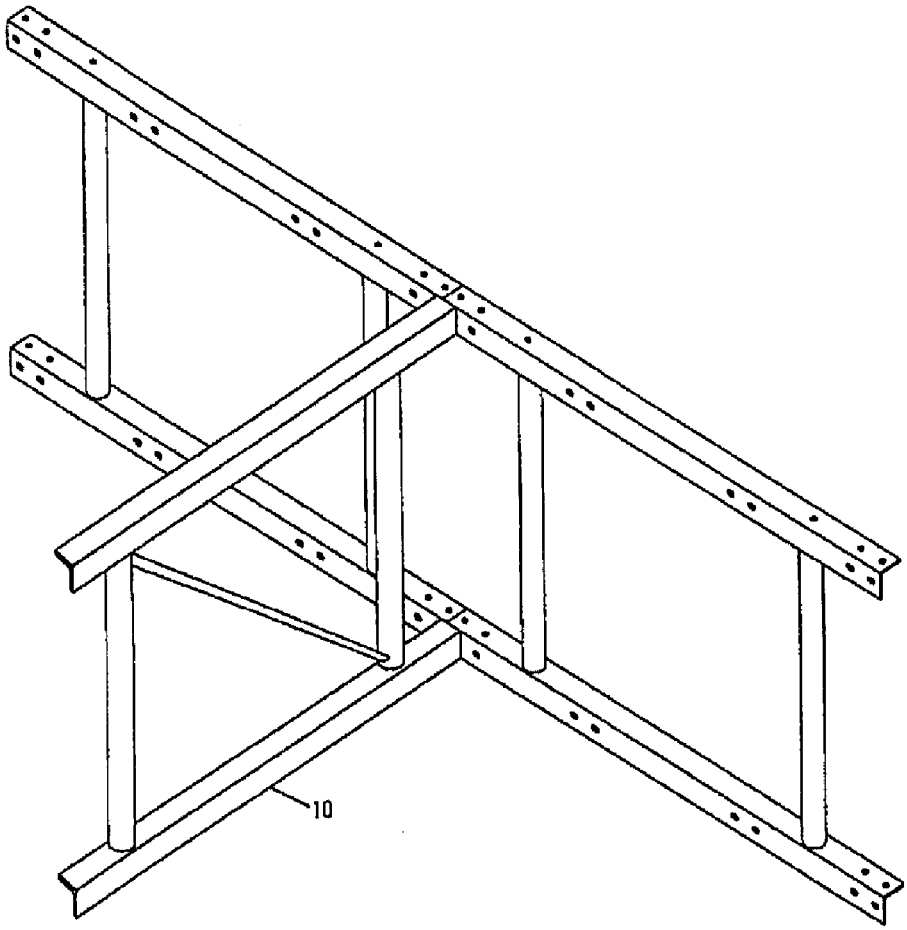
FIG. 6 is an isometric view of a fully opened antenna frame, according to an embodiment.

FIG. 6 is an isometric view of a fully opened antenna frame, according to an embodiment. The antenna frame 10 is fully opened and ready for further installation operations.

Figure 7:
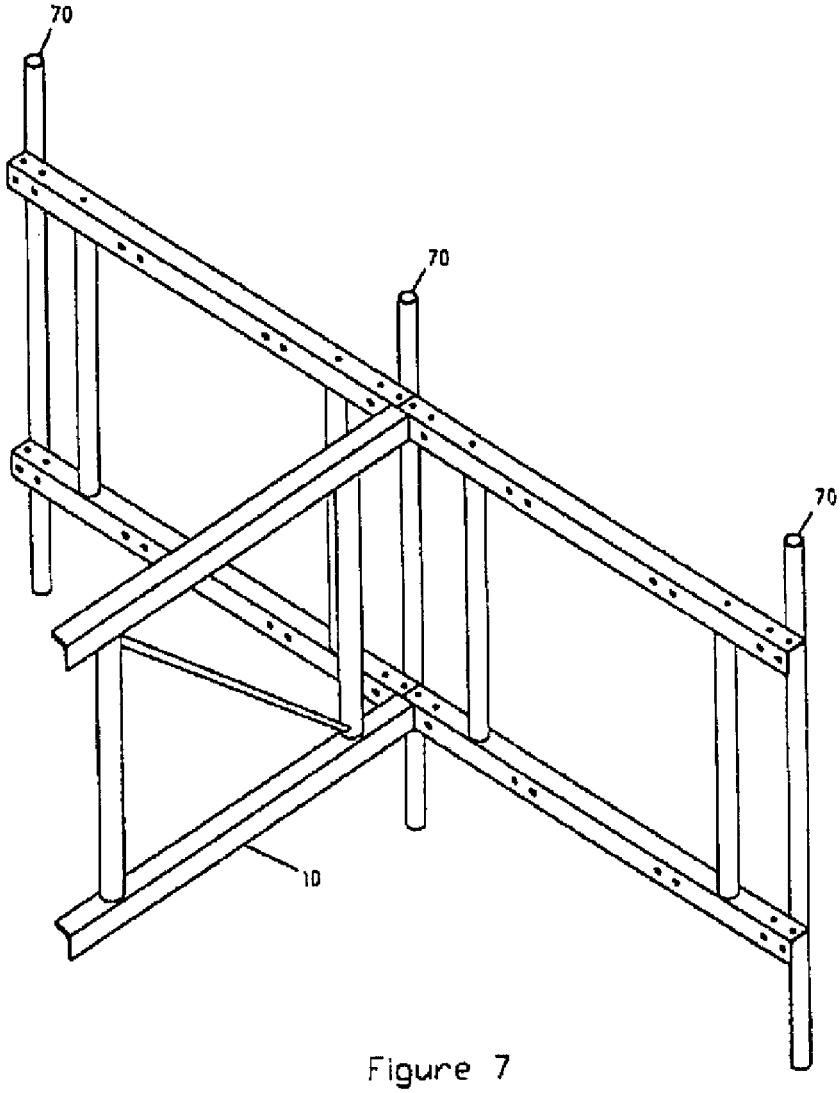
FIG. 7 is an isometric view of a fully opened antenna frame with antenna mounting members attached, according to an embodiment.

FIG. 7 is an isometric view of a fully opened antenna frame with antenna mounting members attached, according to an embodiment. Mounting members 70 are attached to the antenna frame 10 so that the antenna frame 10 can be mounted to a structure such as an antenna tower.

Figure 8:
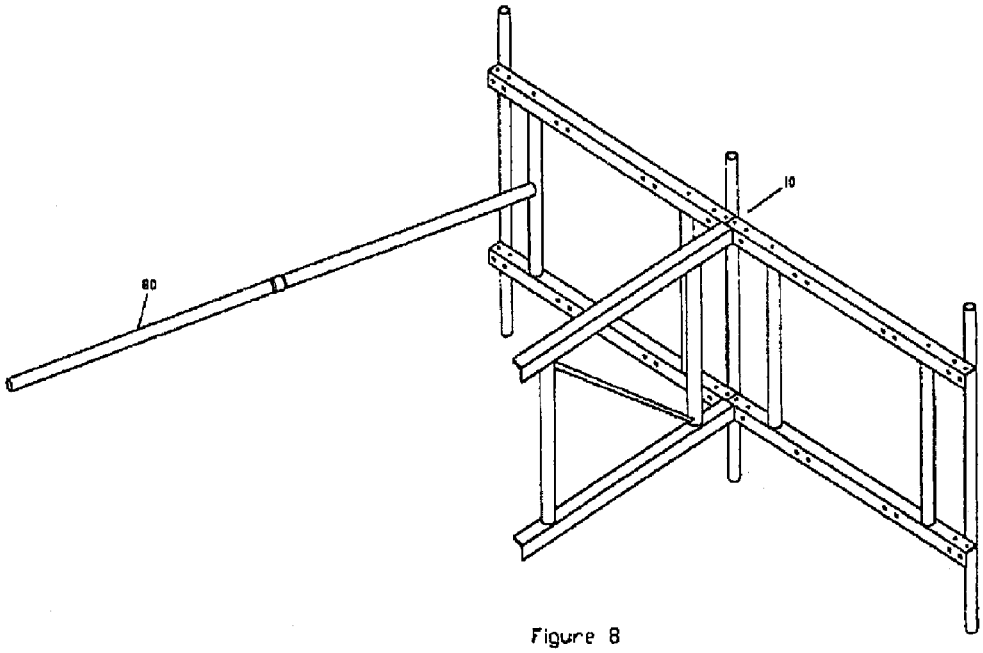
FIG. 8 is an isometric view of a fully opened antenna frame with antenna mounting members attached and a tie back bar attached, according to an embodiment.

FIG. 8 is an isometric view of a fully opened antenna frame with antenna mounting members attached and a tie back bar attached, according to an embodiment. A tie back bar 80 is attached to the antenna frame 10. Note that the tie back bar 80 may be split up into two (or more pieces) for easy storage and transport, and can be assembled into one piece when needed.

Figure 9:
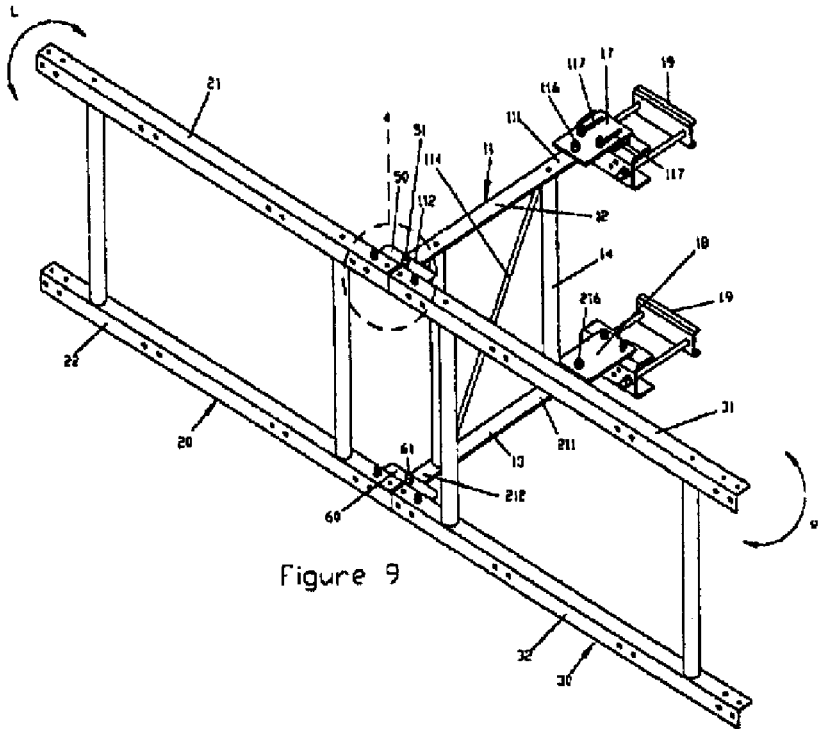
FIG. 9 is an isometric view of an antenna sector frame, according to an embodiment.

FIG. 9 is an isometric view of an antenna sector frame, according to an embodiment.

An antenna sector frame 10 can include a standoff frame 11, an upper pivot plate 50, a lower pivot plate 60, a first face frame 20, and a second face frame 30.

The standoff frame 11 can include an upper horizontal member 12 a lower horizontal member 13 and vertical members 14. The upper horizontal member 12 can have a first end 111 and a second end 112 and can be substantially parallel to the lower horizontal member 13, which can include a first end 211 and a second end 212. Vertical members 14 can be mounted between the upper horizontal member 12 and the lower horizontal member 13 substantially perpendicularly to each. A cross brace 114 can be mounted at one end to the upper horizontal member 12 and proceeds therefrom generally at an angle. The other end of the cross brace 114 can be attached to the lower horizontal member 13. In this configuration, the cross brace 114 can typically provide additional support and rigidity for the standoff frame 11.

The first face frame 20 can include an upper horizontal member 21 and a lower horizontal member 22. The upper horizontal member can include a first end 24 and a second end 26, and the lower horizontal member can include a first end 27 and a second end 28. Vertical members 23 can be attached at one end to the upper horizontal member 21 and can proceed substantially perpendicularly therefrom. The other end of the vertical members 23 can be attached to the lower horizontal member 22. In this configuration, the upper horizontal member 21 and the lower horizontal member 23 can be kept substantially parallel to one another.

A plurality of holes 25 can be formed into, and spaced about the upper horizontal member 21 and the lower horizontal member 22 to allow mounting of the first face frame 20 to the standoff frame 11, as well as to allow antennas to be mounted to the first face frame 20.

An adjustable bracket plate 17 can be mounted at the first end 111 of the upper horizontal member 12 of the standoff frame 11. A bracket plate 18 is mounted at the first end 211 of the lower horizontal member 13 of the standoff frame 11. Tower mounting brackets 19 are attached to the adjustable bracket plate 17 and the bracket plate 18 to mount the standoff frame 11 to a tower (not shown). The tower mounting bracket 19 attached to the adjustable bracket plate 17 can be adjusted along slots in the adjustable bracket plate 17 in order to account for any taper of the tower.

As to be noted below in more detail, the standoff frame can pivot relative to the leg L of the tower T at the pivot axis defined by 116 and 216. The face frame of the antenna sector frame 10 can also pivot relative to the standoff frame at the pivot axis defined by 51 and 61.

Figure 10:
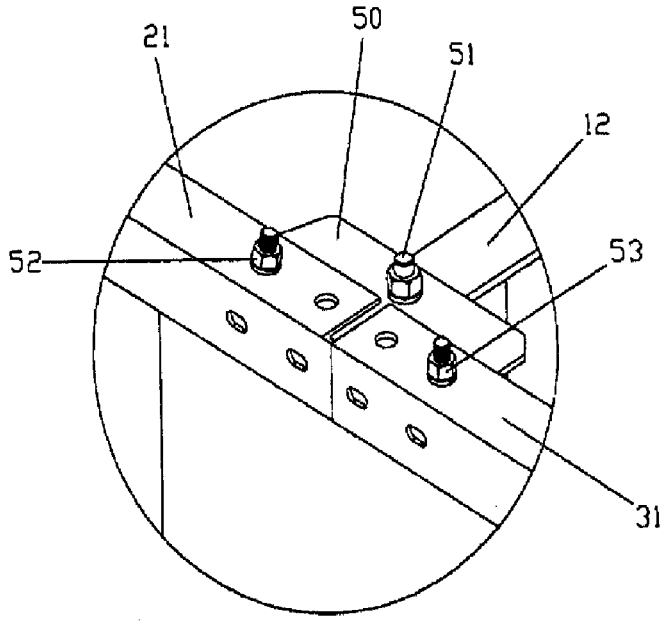
FIG. 10 is an isometric detail view of the pivoting point of the face frame of the antenna sector frame, according to an embodiment.

FIG. 10 is an isometric detail view of the pivoting point of the face frame of the antenna sector frame, according to an embodiment.

The upper horizontal member 21 of the first face frame 20 can be attached to the upper pivot plate 50 at the outer hole 57 (see FIG. 11) of the upper pivot plate 50. A nut and bolt assembly 52 proceed through a hole 25 (see FIG. 12) of the upper horizontal member 21 of the first face frame 20 and through one of the outer holes 57 (see FIG. 11) of the pivot plate 50.

The second upper horizontal member 31 of the second face frame 30 can be attached to the upper pivot plate 50 at the outer hole 57 opposite the outer hole that the upper horizontal member 21 of the first face frame 20 is attached to. A nut and bolt assembly 53 can proceed through a hole 35 of the upper horizontal member 31 of the second face frame 30 and through the outer hole 57 of pivot plate 50. The lower horizontal member 32 of the second face frame 30 can be attached to the lower pivot plate 60 in substantially the same way. The second face frame 30 can thereby be pivotally mounted at the mounting point defined by the nut and bolt assembly 53 and can pivot along arc R.

The lower horizontal member 22 of the first face frame 20 (see FIG. 9) can be attached to the lower pivot plate 60 in substantially the same way. The first face frame 20 is thereby pivotally mounted at the mounting point defined by the nut and bolt assembly 52 and can pivot along arc L (see FIG. 9).

The first face frame 20 and the second face frame 30 can be secured in either position by securing the nut and bolt assemblies 52 and 53, respectively to secure the upper horizontal members 21, 31 of the respective first and second face frames. Additionally, the corresponding nut and bolt assemblies attaching the lower horizontal members 22, 32 of the respective first and second frames to the lower pivot plate 60 can be secured. Additional nut and bolt assemblies can be inserted through the inner holes 59, 69 of the respective pivot plates 50, 60 and the corresponding holes 25 of the upper and lower horizontal members of the first and second face frames to further secure the first face frame 20 and the second face frame 30 in the open, uncollapsed, position.

Referring back to FIG. 9, the antenna sector frame 10 can thereby be collapsed for transport by pivoting the first face frame 20 along the arc L toward the standoff frame 11, and by pivoting the second face frame 30 along the arc R toward the standoff frame. Conversely, the collapsed antenna frame 10 can be opened for installation on a tower by pivoting the first face frame 20 along the arc L away from the standoff frame 11, and pivoting the second face frame 30 along the arc R away from the standoff frame 11 until the first and second face frames 20, 30 are substantially perpendicular in relation to the standoff frame 11.

Figure 11:
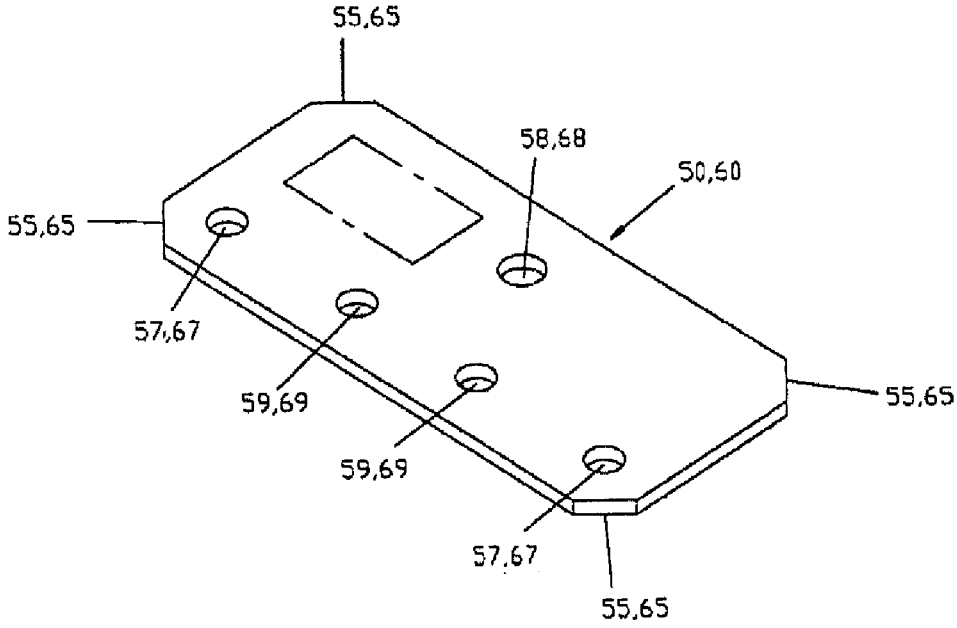
FIG. 11 is an isometric view of an upper pivot plate and a lower pivot plate of the antenna sector frame, according to an embodiment.

FIG. 11 is an isometric view of an upper pivot plate and a lower pivot plate of the antenna sector frame, according to an embodiment.

The upper pivot plate 50 is substantially rectangular in shape and includes notches 55 at each corner. A standoff frame mounting hole 58 is disposed through the generally centrally along one edge of the upper pivot plate 50. Inner face frame mounting holes 59 are disposed through the upper pivot plate 50 proximate to the opposing edge to where the standoff frame mounting hole 58 is disposed. Also along the opposing edge where the inner face frame mounting holes 59 are disposed, are outer face frame mounting holes 57. The upper pivot plate 50 is secured to the second end 112 of the upper horizontal member 12 of the standoff frame 111 by a nut and bolt assembly 51 which passes through a hole at the second end 112 of the upper horizontal member 12 of the standoff frame 11 and through the standoff frame mounting hole 58 of the upper pivot plate 50.

The lower pivot plate 60 is substantially rectangular in shape and includes notches 65 at each corner. A standoff frame mounting hole 68 is disposed through the generally centrally along one edge of the lower pivot plate 60. Inner face frame mounting holes 69 are disposed through the lower pivot plate 60 proximate to the opposing edge to where the standoff frame mounting hole 68 is disposed. Also along the opposing edge where the inner face frame mounting holes 69 are disposed, are outer face frame mounting holes 67. The lower pivot plate 60 is secured to the second end 212 of the lower horizontal member 13 of the standoff frame 11 by a nut and bolt assembly 61 which passes through a hole at the second end 212 of the lower horizontal member 13 of the standoff frame 11 and through the standoff frame mounting hole 68 of the lower pivot plate 60.

The notches 55 of the of the upper pivot plate 50 and the notches 65 of the lower pivot plate 60 can provide an open area in which the upper and lower horizontal members of the first and second face frames can pivot about their pivot axis.

Figure 12:
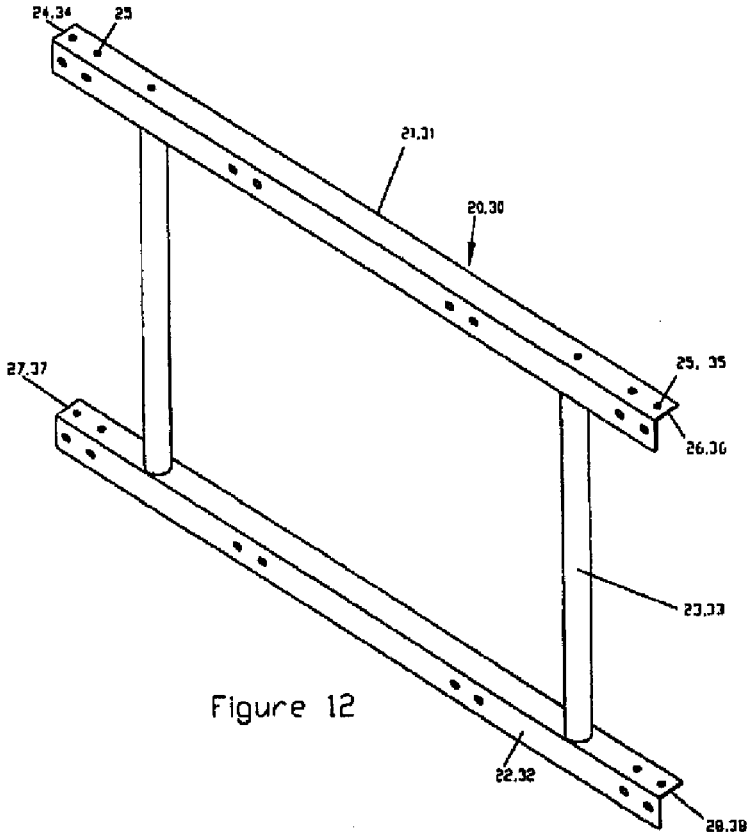
FIG. 12 is an isometric view of a face frame of the antenna sector frame, according to an embodiment.

FIG. 12 is an isometric view of a face frame of the antenna sector frame, according to an embodiment.

The second face frame 30 can include an upper horizontal member 31 and a lower horizontal member 32. The upper horizontal member includes a first end 34 and a second end 36, and the lower horizontal member includes a first end 37 and a second end 38. Vertical members 33 can be attached at one end to the upper horizontal member 31 and proceed substantially perpendicularly therefrom. An opposite end of the vertical members 33 are attached to the lower horizontal member 32. In this manner, the upper horizontal member 31 and the lower horizontal member 33 are kept substantially parallel to one another. A plurality of holes 35 can be formed into, and spaced about the upper horizontal member 31 and the lower horizontal member 32 to allow for mounting the second face frame 30 to the standoff frame 11, as well as to allow antennas to be mounted to the second face frame 30.

In an embodiment of the present inventive concept, the upper and lower horizontal members of the first and second face frames can be 72 inches long, however any length known to one of ordinary skill in the art may be used.

Figure 13:
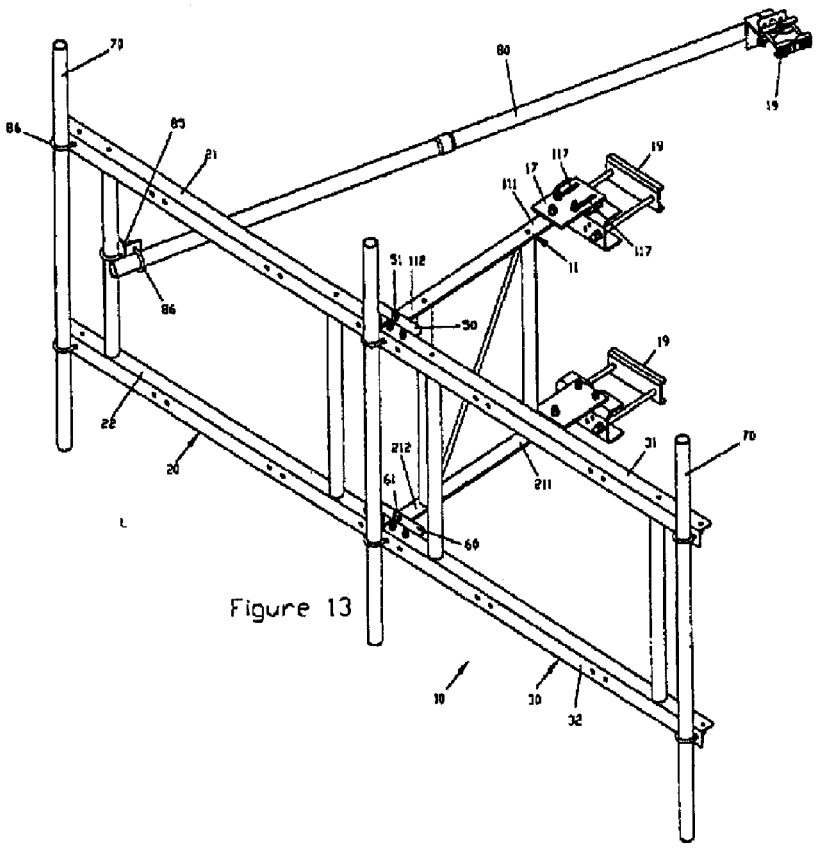
FIG. 13 is an isometric view of an assembled antenna sector frame, according to an embodiment.

FIG. 13 is an isometric view of an assembled antenna sector frame, according to an embodiment.

Antenna mounting members 70 can be attached to the first face frame 20 and the second face frame 30. In an embodiment, the antenna mounting members 70 can be attached to the first and second face frames by U-bolts 86. However, the antenna mounting members 70 can be mounting using any fasteners known to one of ordinary skill in the art.

A tie back bar 80 can be attached to any one of the vertical members 23, 33 of the first and second face frames, respectively. The tie back bar 80 can be formed of a stiff pipe. The tie back bar 80 can be attached to the vertical member 23 or 33 by an angle bracket 85 and U-bolts 86. Disposed at a distal end of the tie back bar 80 is an additional tower mounting bracket 19 to attach the tie back bar 80 to the tower.

Figure 14:
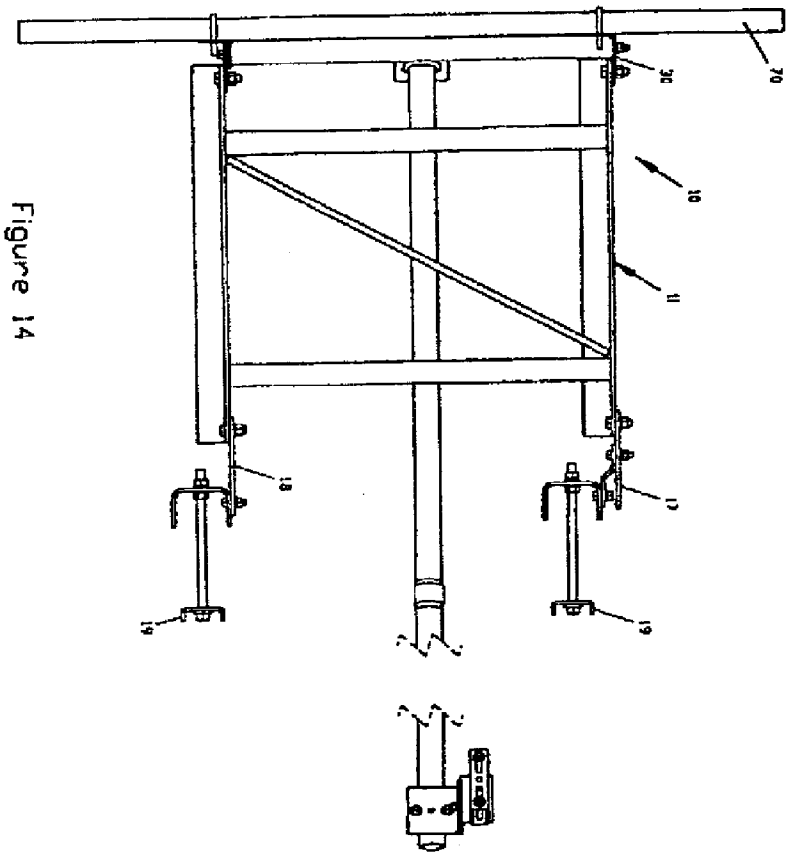
FIG. 14 is a right side elevation of an assembled antenna sector frame, according to an embodiment.

FIG. 14 is a right side elevation of an assembled antenna sector frame 10. Antenna mounting members 70 can be mounted to face frame 30 which is connected to the standoff frame 11. an adjustable bracket plate 17 is connected to the tower mounting bracket 19. A bracket 18 is connected to another tower mounting bracket 19.

Figure 15:
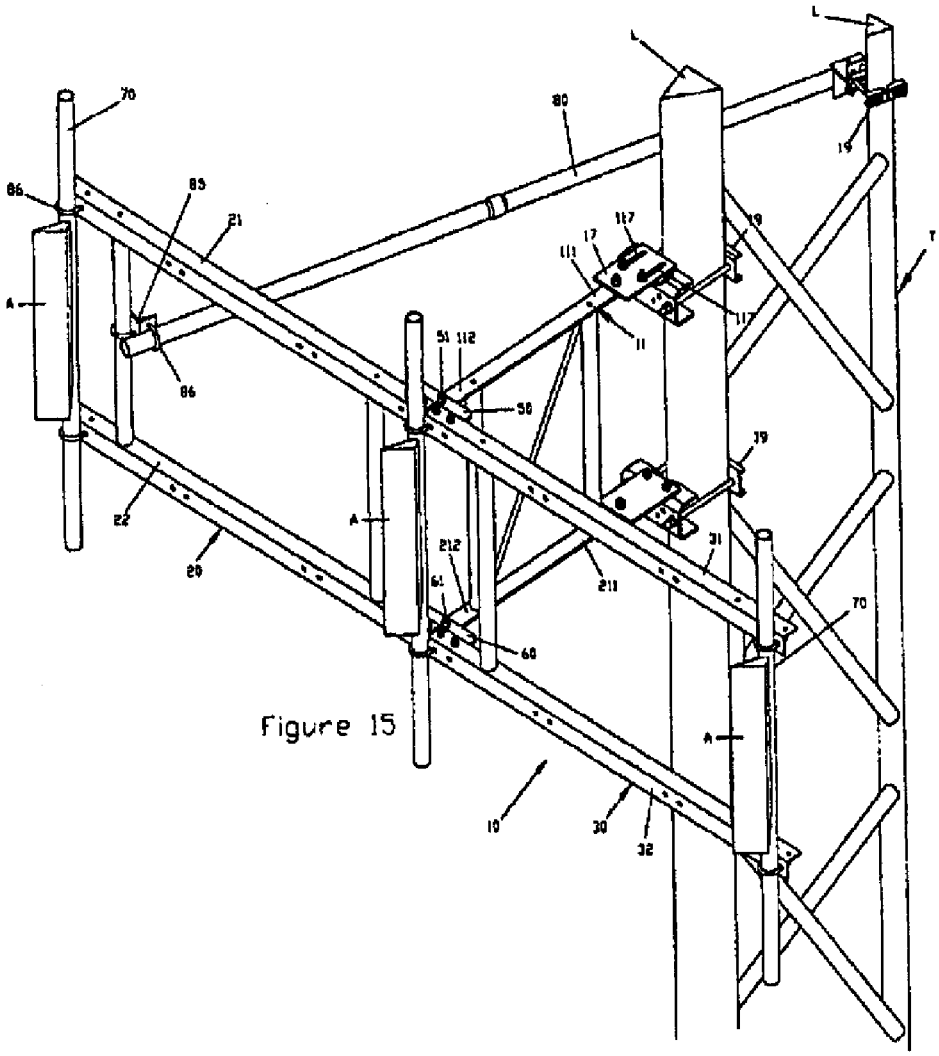
FIG. 15 is a perspective view of an assembled antenna sector frame mounted to a tower, according to an embodiment.

FIG. 15 is a perspective view of an assembled antenna sector frame 10 mounted to a tower T. The tower mounting bracket 19 can be adjusted along the slots 117 in the adjustable bracket plate 17 in order to account for any taper to the leg L of the tower T. Thus, the sector frame can be tilted through a continuous range of tilt settings with respect to the tower to compensate for tilt in the tower.

Additionally, the tower mounting bracket 19 connected to the bracket 18 is mounted to the tower leg L. The tieback arm 80 is attached to an additional leg L of the tower T, and provides further stability for the antenna sector frame 10. The standoff frame 11 can be tilted upward or downward by sliding the nut and bolt assembly along slots 117 of the adjustable bracket plate 17 and then tightening the nut and bolt assemblies. Antennas A can be mounted to the vertical bars 70 for telecommunications.

Figure 16C:
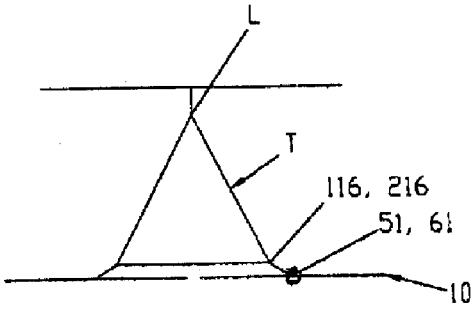
FIG. 16*c* is a top plan view illustrating a dual-pivoting action, according to an embodiment.
Figure 16B:
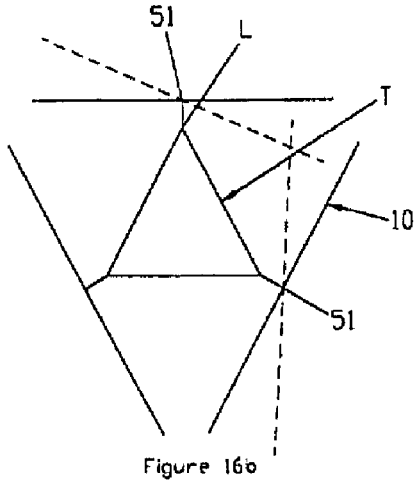
FIG. 16*b* is a top plan view illustrating potential interference of face frames.
Figure 16A:
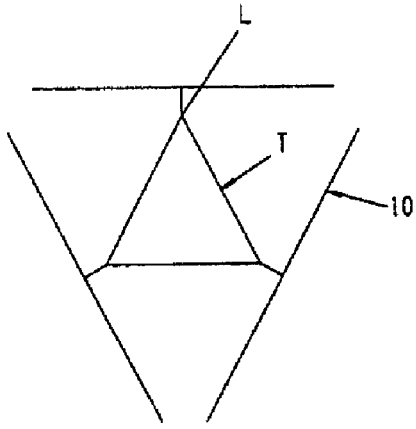
FIG. 16*a* is a top plan view of assembled antenna sector frames mounted to tower T.

FIG. 16*a* is a top plan view of assembled antenna sector frames mounted to tower T. The antenna sector frame 10 is in a nominal configuration and is mounted to the legs L on a tower T. In this configuration, the standoff frame can be generally perpendicularly mounted to the tower T, and are mounted in a substantially 120 degree arrangement relative to one another. The face frames can be generally perpendicular in relation to the standoff frames. It is, however, sometimes needed to arrange the face frames in an arrangement that will allow the antennas mounted to the face frames to face directions other than the normal configuration depicted in FIG. 16*a*.

FIG. 16*b* is a top plan view illustrating potential interference of face frames. On a typical sector frame where only the face frame pivots with respect to the standoff frame at pivot axis 51, the face frames can shadow or physically interfere with one another at their ends as shown by the dotted line representation of a pivoted face frame.

FIG. 16*c* is a top plan view illustrating a dual-pivoting action, according to an embodiment. The face frame of the antenna sector frame 10 can pivot relative to the standoff frame at the face frame pivot axis defined by 51 and 61, and the standoff frame can pivot relative to the leg L of the tower T at support pivot axis defined by 116 and 216. In this manner, multiple antenna sector frames 10 can be mounted and pivoted to a variety of angles on the tower T without interfering with one another.

Thus, the present general inventive concept has many advantages. The antenna sector frame can be collapsed by pivoting the face frames to a position where they are substantially planar to the standoff frame, facilitating storage, transport and the like. The antenna sector frame can be easily and quickly assembled at the site of installation by pivoting the face frames to an extended position and securing them in place, thereby reducing the cost and time necessary to assemble the antenna sector frame. The antenna sector frame can also include pivoting face frames upon which antennas can be mounted.

While the preferred embodiment of the present general inventive concept has been described and illustrated, modifications may be made by one of ordinary skill in the art without departing from the scope and spirit of the inventive concept as defined in the appended claims. For example, in a preferred embodiment of the present inventive concept, a nut and bolt assembly is described as a preferred fastener to attach and mount various components of the antenna sector frame to one another. However, any fastener known to one of ordinary skill in the art may be used in the place of a nut and bolt assembly.

What is claimed is:

1. A sector frame, comprising:

a standoff frame having a first end and a second end, wherein the first end of the standoff frame is adapted for mounting to an antenna tower;

at least one pivot plate mounted at the second end of the standoff frame; a first face frame, pivotally mounted to the pivot plate; and a second face frame, pivotally mounted to the pivot plate, wherein the standoff frame further comprises an upper horizontal member, having a first and second end, and a lower horizontal member, having a first and second end, said upper and lower horizontal members connected together by at least one vertical member, wherein the at least one pivot plate is mounted at the second end of the lower horizontal member, wherein the at least one pivot plate is mounted at the second end of the upper horizontal member, wherein a pivot plate is mounted at the second end of the lower horizontal member, wherein the first face frame comprises an upper horizontal member having a first end and a second end, and a lower horizontal member having a first end and a second end, wherein said first end of the upper horizontal member of the first face frame is pivotally mounted upon the pivot plate mounted at the second end of the upper horizontal member of the standoff frame, and said first end of the lower horizontal member of the first face frame is pivotally mounted upon the pivot plate mounted at the second end of the lower horizontal member of the standoff frame.

2. The sector frame of claim 1, wherein the second face frame comprises an upper horizontal member having a first end and a second end, and a lower horizontal member having a first end and a second end, wherein said first end of the upper horizontal member of the second face frame is pivotally mounted upon the pivot plate mounted at the second end of the upper horizontal member of the standoff frame, and said first end of the lower horizontal member of the second face frame is pivotally mounted upon the pivot plate mounted at the second end of the lower horizontal member of the standoff frame.

* * * * *